US006412485B1

(12) United States Patent
Saieva

(10) Patent No.: US 6,412,485 B1
(45) Date of Patent: Jul. 2, 2002

(54) SURFACE BREATHING VENT FOR BREATHING APPARATUS

(76) Inventor: Carl J. Saieva, 17 Sands La., Port Jefferson, NY (US) 11777

( * ) Notice: Subject to any disclaimer, the term of this patent is extended or adjusted under 35 U.S.C. 154(b) by 0 days.

(21) Appl. No.: 09/209,743

(22) Filed: Dec. 11, 1998

(51) Int. Cl.[7] ..... A62B 9/02

(52) U.S. Cl. ..... 128/205.24; 128/202.27; 128/205.25; 128/207.12

(58) Field of Search ..... 128/204.26, 204.27, 128/205.22, 205, 24, 207.12, 201.24, 201.25, 201.29, 202.27, 205.25, 205.07, 206.12, 206.15, 206.17

(56) References Cited

U.S. PATENT DOCUMENTS

| | | | | | |
|---|---|---|---|---|---|
| 417,795 | A | * | 12/1889 | Starr | 128/207.12 |
| 2,456,130 | A | * | 12/1948 | Lambertsen | 128/205.22 |
| 2,837,090 | A | * | 6/1958 | Bloom et al. | 129/201.19 |
| 2,997,550 | A | * | 8/1961 | Traller | 128/201.19 |
| 3,129,707 | A | * | 4/1964 | Becker et al. | 128/205.22 |
| 3,180,333 | A | * | 4/1965 | Lewis | 128/201.19 |
| 3,181,531 | A | * | 5/1965 | Angioletti | 128/201.19 |
| 3,540,422 | A | * | 11/1970 | Holloway | 128/201.19 |
| 3,678,959 | A | * | 7/1972 | Liposky | 137/625.11 |
| 4,226,234 | A | * | 10/1980 | Gunderson | 128/205.24 |
| 4,276,877 | A | * | 7/1981 | Gdulla | 128/200.27 |
| 4,373,520 | A | * | 2/1983 | Arbique | 128/201.19 |
| 4,522,639 | A | * | 6/1985 | Ansite et al. | 55/314 |
| 4,905,683 | A | * | 3/1990 | Cronjaeger | 128/202.22 |
| 5,127,398 | A | * | 7/1992 | Stone | 128/204.18 |
| 5,572,990 | A | * | 11/1996 | Berlin | 128/201.19 |
| 5,845,637 | A | * | 12/1998 | Knott | 128/107.12 |
| 5,960,793 | A | * | 10/1999 | Matsuoka et al. | 128/204.26 |

FOREIGN PATENT DOCUMENTS

| | | | | |
|---|---|---|---|---|
| WO | WO 95/32023 | * | 11/1995 | 128/205.24 |

* cited by examiner

*Primary Examiner*—John G. Weiss
*Assistant Examiner*—Joseph F. Weiss, Jr.
(74) *Attorney, Agent, or Firm*—Galgano & Burke

(57) ABSTRACT

A surface breathing vent device for a mask permits the user wearing the mask to breathe ambient air prior to diving under water or entering an oxygen-poor environment and includes a support plate couplable to the mask and provided with an opening in alignment with the com port of the face mask, a bushing provided in the opening, and a vent barrel received in the bushing and movable between an open position in which ambient air can pass into the mask and a closed position where water is prevented from entering the mask. The barrel includes a closed end and two lateral openings which permit air to pass therethrough when the barrel is in the open position. A first O-ring prevents the inadvertent removal of the barrel from the bushing, a second O-ring functions as a detent when the barrel is opened and closed, and a third O-ring provides a water and air tight seal when the barrel is in a closed position. A microphone can be attached to the vent device such that the vent device serves the dual purpose of a com port and breathing vent. In addition, because of the location of the com port over which the vent device is coupled, the air flow through the vent device travels directly into the nose and out of the mouth and does not pass the visor of the face mask outside the oral-nasal cup. As a result, there exists relatively little dead space for the build-up of $CO_2$ and little chance of fogging the visor. As radial openings form the air passage, a relatively large vent area is provided.

17 Claims, 7 Drawing Sheets

SURFACE BREATHING VENT FOR BREATHING APPARATUS

BACKGROUND OF THE INVENTION

1. Field of the Invention

This invention relates broadly to a surface breathing vent for a breathing apparatus. More particularly, this invention relates to a vent device which is especially intended for air masks used in life support breathing systems, such as those used in scuba diving or toxic environments.

2. State of the Art

SCUBA equipment is used to permit a diver to breathe underwater from an auxiliary breathing gas supply. Typical SCUBA equipment generally includes a face mask, a mouth piece, a tank containing a breathing gas mixture containing oxygen, a hose extending from the tank, and a regulator coupled between the hose and the mouth piece which regulates the amount of breathing gas available to the diver and for permitting the release of exhaled breathing gas. A diver can remain underwater only for the duration permitted by the amount of the breathing gas in the tank. Conservation of the breathing gas is therefore paramount in determining the length of time available for a dive.

Referring to prior art FIG. 1, a 'full' face mask 10 may be used in lieu of a separate face mask and mouthpiece. Such a mask is typical in military and commercial dive applications. The full face mask 10 includes a visor 12 which covers the eyes of the diver, and an oral-nasal cup 14 which surrounds the nose and mouth of the diver in lieu of a mouthpiece. The oral-nasal cup 14 is coupled to an external rigid support 16 to which a regulator 18 is attached. The support 16, especially in military and commercial dive applications, often includes a communications port (com port) 20 which leads directly into the oral-nasal cup 14. The com port 20 receives a microphone (not shown), thereby facilitating underwater communications between several divers and surface personnel. The mask 10 also includes a plurality of straps 22 which securely attach the mask to the diver's head. Once correctly adjusted, the straps 22 help create a water tight fit for the visor 12 and oral-nasal cup 14 over the face of the diver. Thus, the mask is not readily attached to or removed from the diver's head. Consequently, attachment of the mask 10 usually occurs prior to leaving shore, with the diver waiting in a dive boat with the full mask securely positioned over the diver's face. Because it is not easy for the diver to remove the mask once it is attached, the diver is required to use the limited breathing gas in the tank from the time the mask is secured over the face. As such, valuable breathing gas is used prior to beginning the dive.

Referring now to prior art FIG. 2, in response to this concern, an after-market vent device 30, sold under the trademark GILL by Tech-One, Inc., may be installed in the mask 10. The vent device 30 permits ambient air to enter and exit the mask 10 with the mask attached to the diver's head such that the diver may breathe ambient air, rather than breathing gas in the tank while waiting on the surface prior to a dive. The vent device 30 is installed by drilling a hole 32 into the side of the visor 12 at eye level. An inner collar 34 of the vent device 30 is then fit into the hole 32. Two O-rings 36, 38 between the visor 12 and the vent device 30 form a waterproof seal. An outer collar 40 is movable axially over the inner collar 34. Collar 40 can be pulled laterally outward from the mask to provide a vent opening 42 in the end of the device 30 which allows ambient air (dotted line 44) into and out of the face mask for breathing by the diver.

Pushing the outer collar 40 inward over the inner collar 34 closes the vent opening 42 from ambient air and from water entry when under water.

However, the device has several drawbacks. First, the drilled hole 32 voids the manufacturer's warranty of the face mask. Second, the pathway for ambient air to travel from the vent opening 42 requires the air to flow past the visor which tends to cause the visor to fog and obstruct the vision of the diver. In addition, the eye level position of the vent device 30 provides a rather large dead space between the mouth and nose of the diver and the vent opening 42 which permits $CO_2$ buildup in the mask. Third, the vent device 30 projects outwardly from the side of the face mask 10 thereby creating the potential for entanglement with fish lines and the like. Moreover, there is the possibility that the vent device 30 may be caught or struck by an obstacle and cause the visor 12 to fracture or cause an imperceptible defect which during a dive allows water to enter the mask and flood the oral-nasal cup 14.

SUMMARY OF THE INVENTION

It is therefore an object of the invention to provide a surface breathing vent device for a full mask breathing apparatus which is specifically intended for use by scuba divers, firemen and others in toxic gaseous or oxygen-reduced environments.

It is another object of the invention to provide a surface breathing vent device which when installed in a full mask will not void the warranty of the mask.

It is a further object of the invention to provide a surface breathing vent device which will not disturb the integrity of the visor of the mask.

It is an additional object of the invention to provide a surface breathing vent device which will not protrude from the side of the mask.

It is also an object of the invention to provide a surface breathing vent device which is optimally positioned for breathing ambient air.

It is still another object of the invention to provide a surface breathing vent device which does not create dead space permitting the buildup of $CO_2$.

It is still a further object of the invention to provide a surface breathing vent device which does not cause ambient air to pass in front of the visor, and therefore has a reduced likelihood of fogging.

In accord with these objects, which will be discussed in detail below, a surface vent device is provided for a full SCUBA mask which permits a diver wearing the mask to breathe ambient air prior to entering water. The vent device includes a support plate provided with an opening, the support plate being affixed to the rigid support of the face mask over the con port of the face mask, a bushing provided in the opening, and a vent barrel received in the bushing and movable between an open position in which ambient air can pass into the mask and a closed position in which water is prevented from entering the mask. The barrel includes a closed end and two lateral openings which permit air to pass therethrough when the barrel is in the open position. The barrel is provided with a first O-ring which prevents the inadvertent removal of the barrel from the support plate, a second O-ring which functions as a detent when the barrel is closed and further functions as a friction ring to maintain the barrel in an open position when so desired, and a third O-ring provides a water and air tight seal when the barrel is in a closed position.

A microphone may be attached to the vent device such that the vent device serves the dual purpose of a com port and a surface breathing vent. In addition, because of the location of the vent device over the com port, the air flow through the vent device travels directly into the mouth and nose and does not pass the visor of the face mask outside the oral-nasal cup. As a result, there exists relatively little dead space for the build-up of $CO_2$and there is little chance that the visor will fog. Moreover, there is no need to drill or cut a hole in the visor; as such, the warranty of the mask is not affected. Furthermore, as two lateral holes are provided for the passage of air, a relatively larger vent area is provided than with the prior art device.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
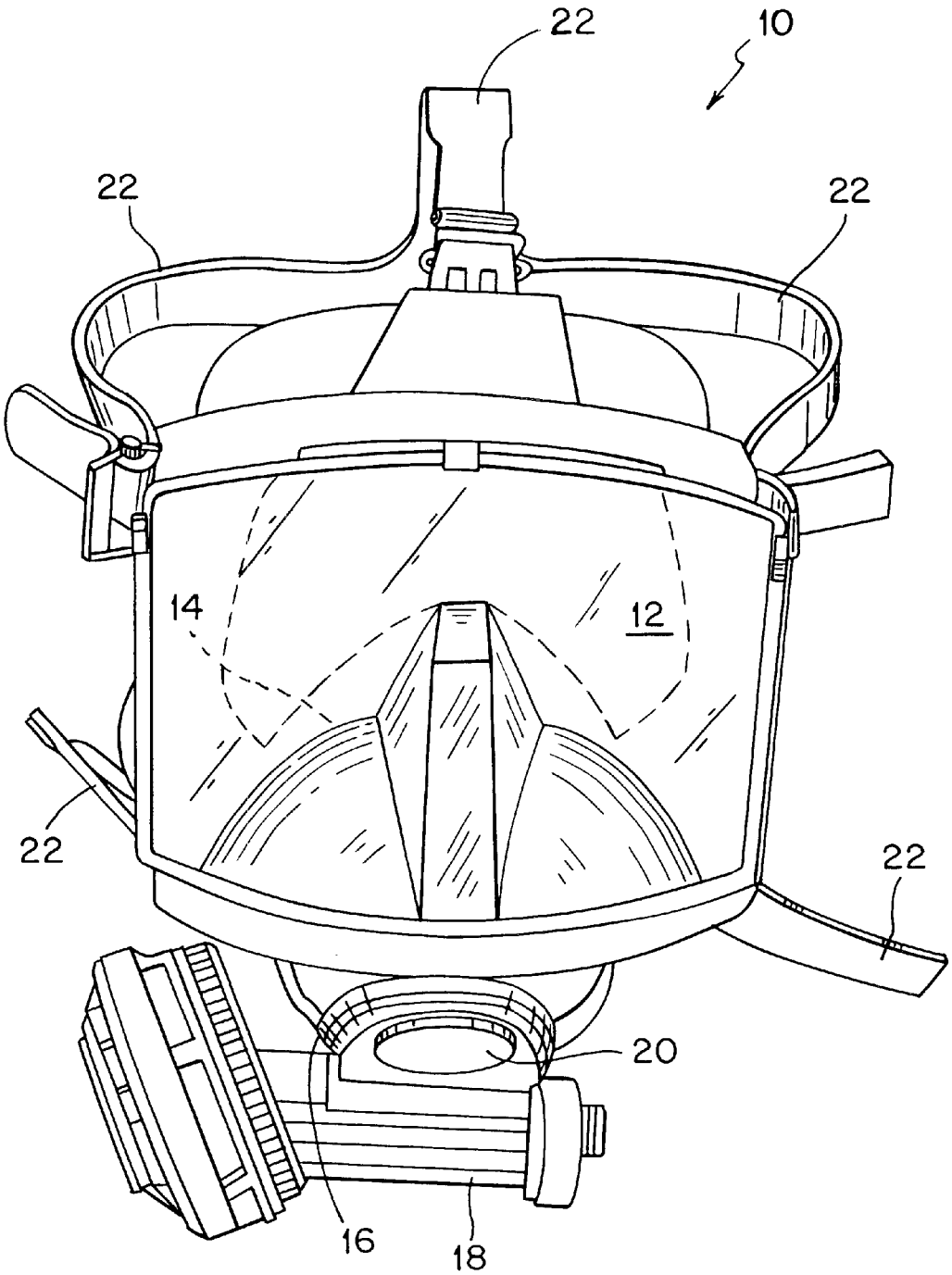
FIG. 1 ( PRIOR ART )
FIG. 1 is a front view of a prior art full SCUBA mask.
Figure 2:
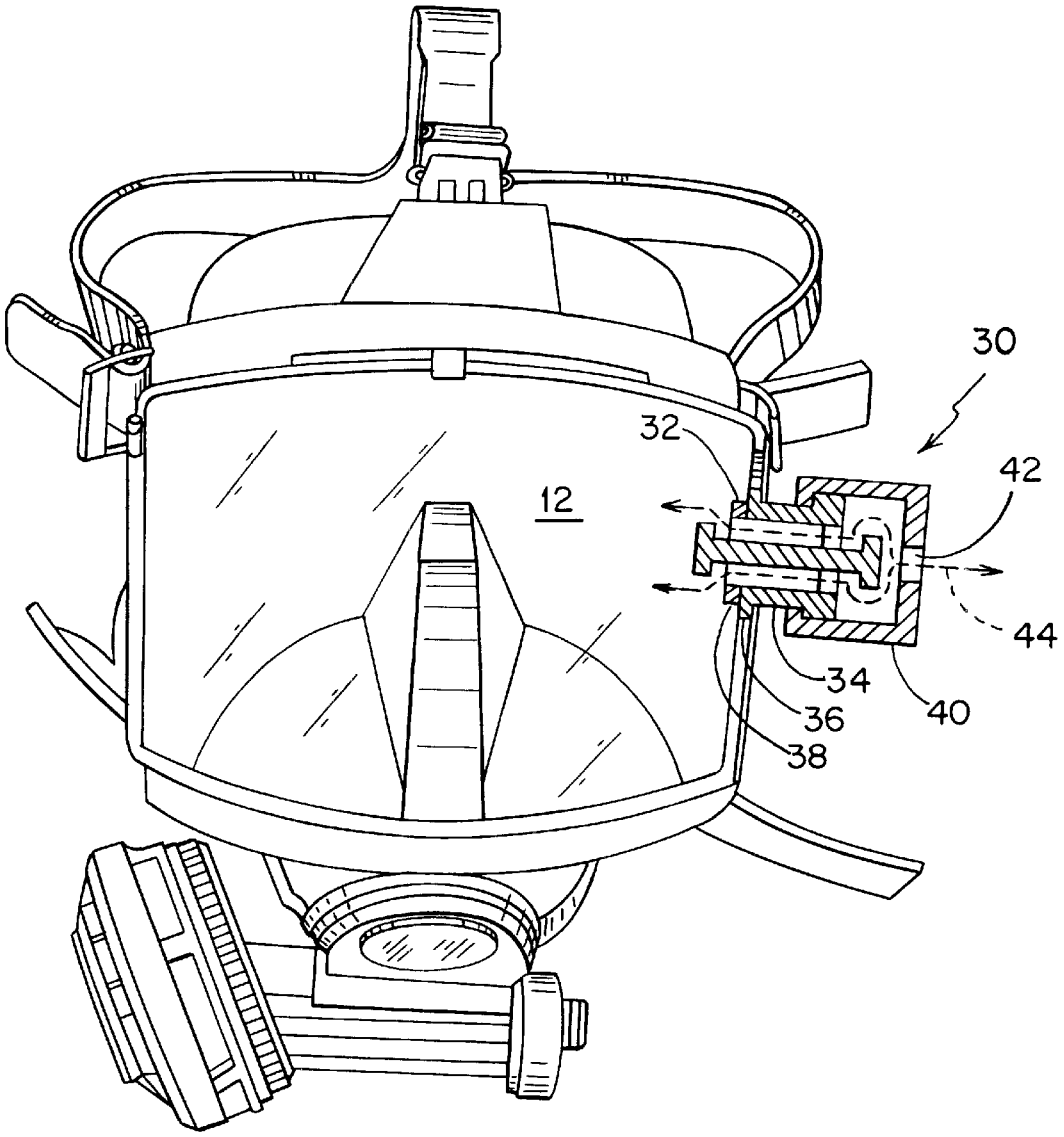
FIG. 2 (PRIOR ART)
FIG. 2 is a front view of a prior art full SCUBA mask with a prior art surface breathing vent device shown in section.
Figure 3:
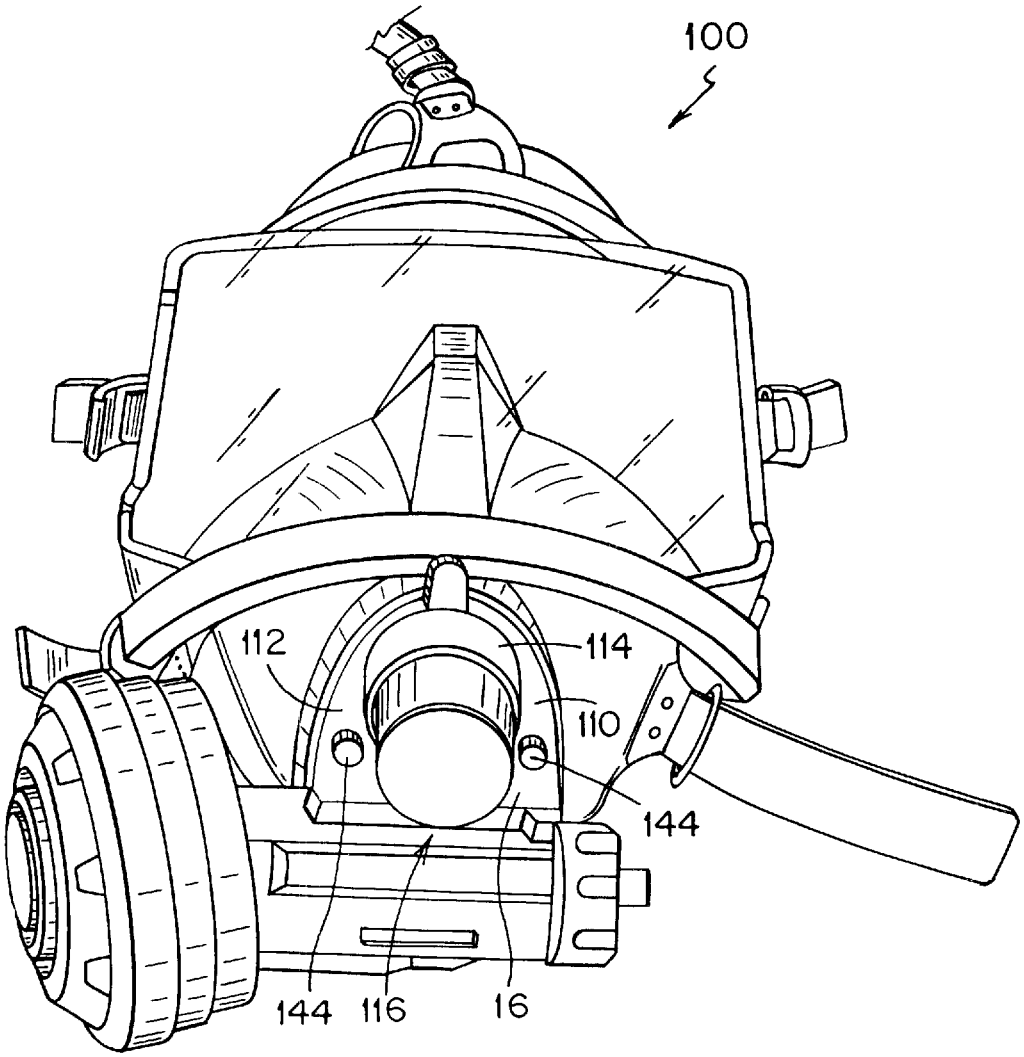
FIG. 3 is a front view of a full SCUBA mask modified with the surface breathing vent device of the invention.
Figure 4:
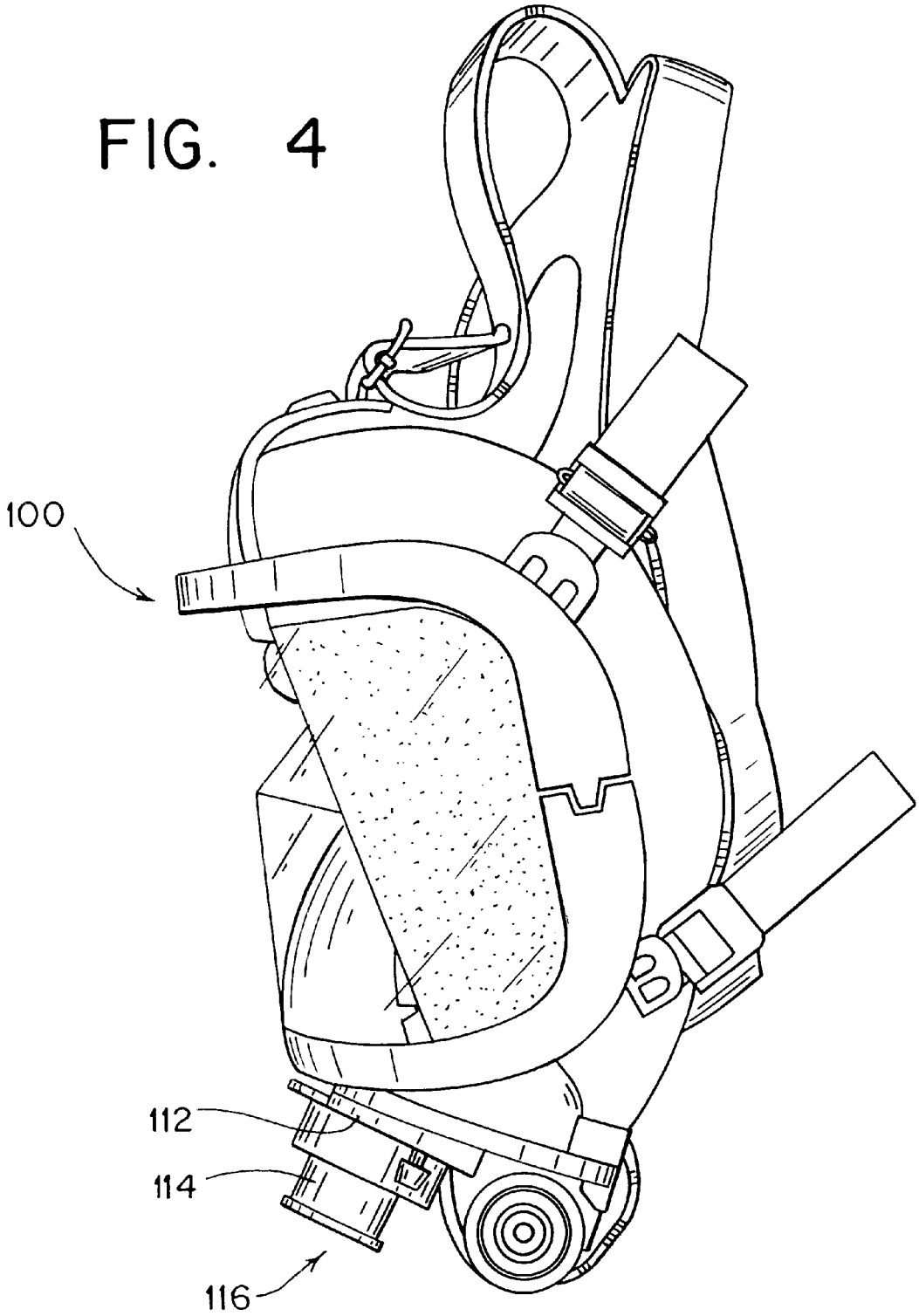
FIG. 4 is a side view of a full SCUBA mask modified with the surface breathing vent device of the invention.

Turning now to FIGS. 3 and 4, a full SCUBA mask 100 provided with the surface breathing vent device 110 according to the invention is shown. The surface breathing vent device 110 permits a diver wearing the mask 100 to breathe ambient air prior to diving under water. Referring to FIGS. 5 through 10, the surface breathing vent device 110 generally includes a standard support plate 112, a bushing 114, a barrel 116, and four O-rings 118, 120, 122, 124.

Figure 7:
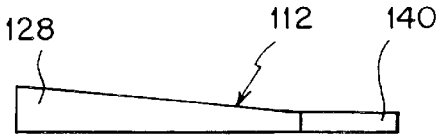
FIG. 7 is a side elevation view of the face plate component shown in FIG. 6.
Figure 6:
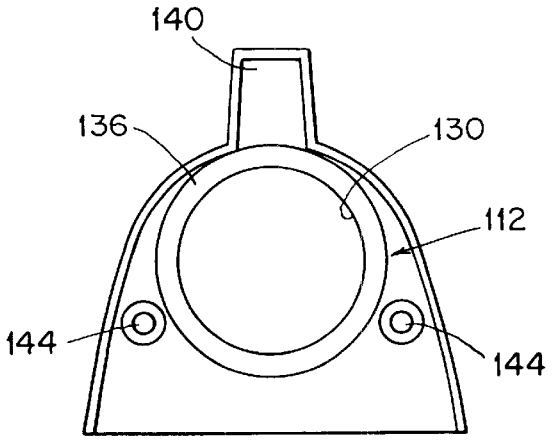
FIG. 6 is a plan view of a face plate component of the surface breathing vent device of the invention.

Referring in particular to FIGS. 6 and 7, the support plate 112 which is found in some conventional masks and is typically removable to allow for attachment e.g. of a microphone assembly to the face mask. This support plate 12 has been modified by machining to provide a central round hole 130 therethrough. A flange 140 is provided at one end of the plate 112, and the plate 128 is tapered toward the flange 140. Two relatively small holes 142 are provided in the plate 112 for receiving connectors 144 (FIG. 3) therethrough to couple the plate 112 to the existing rigid support 16 over the com port of the mask 100 (FIG. 3).

Figure 5:
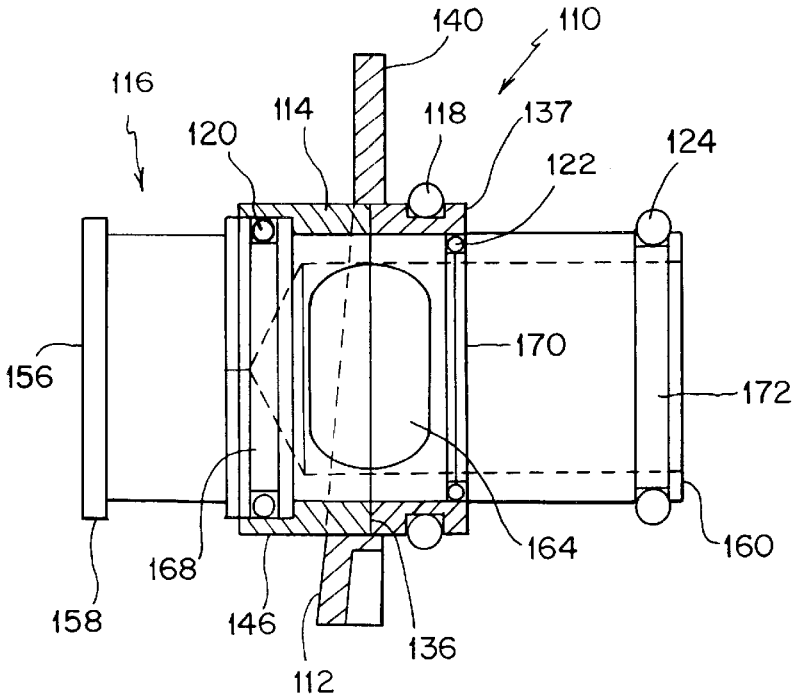
FIG. 5 is a partially transparent side elevation view in partial section of the surface breathing vent device of the invention shown in a closed position.
Figure 8:
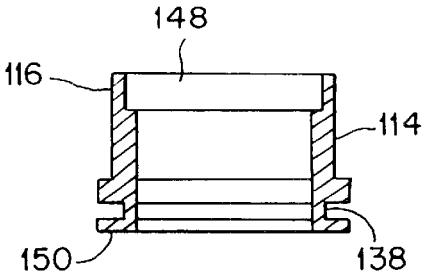
FIG. 8 is a sectional view of a bushing component of the surface breathing vent device of the invention.

Turning now to FIGS. 5 and 8, a bushing 114 is fixed in opening 130 which includes a first end 146 provided with a stepped opening 148, disposed outwardly of the opening 130. The bushing 114 extends into the hole 130 in the support plate 112, with the second end 150 of the bushing. A first O-ring 118 is provided in the groove 138 and provides a water-tight coupling between the bushing and mask or the entryway of the com port (not shown).

Figure 9:
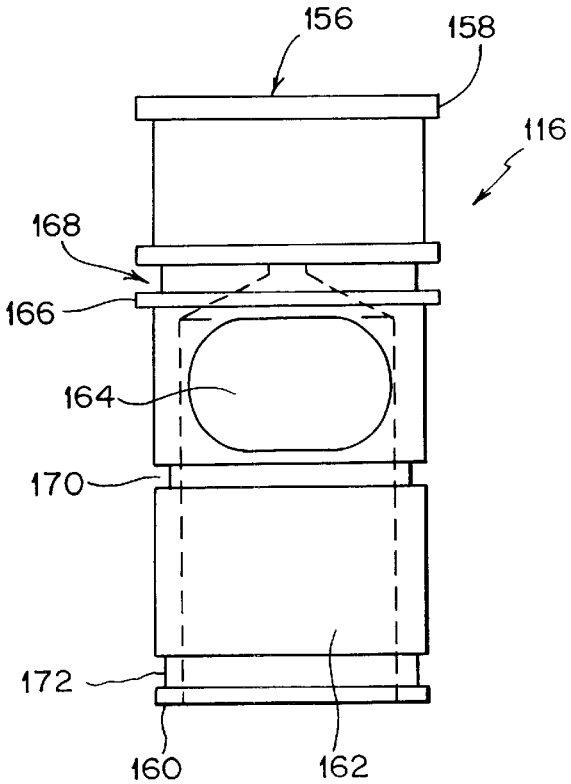
FIG. 9 is a side elevation view of a barrel component of the surface breathing vent device of the invention.
Figure 10:
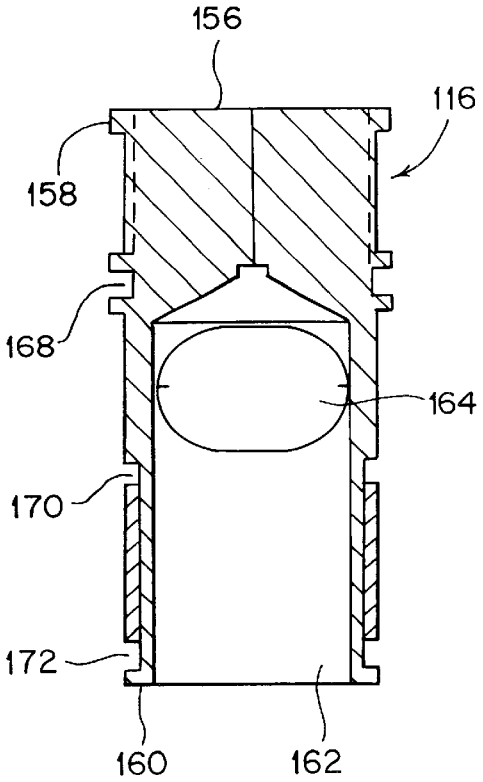
FIG. 10 is a longitudinal sectional view of the barrel component shown in FIG. 9.

Turning now to FIGS. 9 and 10, the barrel component 116 includes a closed first end 156 provided with a lip 158 which facilitates gripping by a diver using a mask 100 provided with the surface breathing vent device 110, a second end 160, and a longitudinal bore 162 extending approximately two-thirds into the barrel from the second end 160. Two, preferably oval, vent openings 164, preferably 180 degrees apart from each other, are provided in the barrel 116 such that the openings 164 intersect the longitudinal bore 162. The openings 164 are preferably at substantially right angles to the longitudinal bore 162. A pair of spaced apart circumferential flanges 166 extend about the exterior of the barrel 116 on the 'first end' side of the openings 164, and define a first circumferential groove 168. The diameter of the barrel 116 across the flanges 166 is sized to fit within the stepped opening 148 of the bushing 114 (FIGS. 5 and 8). A second circumferential groove 170 is provided on the exterior of the barrel on the 'second end' side of the openings 164, and a third circumferential groove 172 is provided proximate the second end 160 of the barrel 116. As shown in FIG. 5, the second O-ring 120 is provided in the first circumferential groove 168 of the barrel 116, the third O-ring 122 is provided in the second circumferential groove 170 of the barrel, and the fourth relatively large O-ring 124 is provided in the third circumferential groove 172 (after the barrel has been inserted through the bushing 114 and the hole 130 in the support plate 112).

Figure 11:
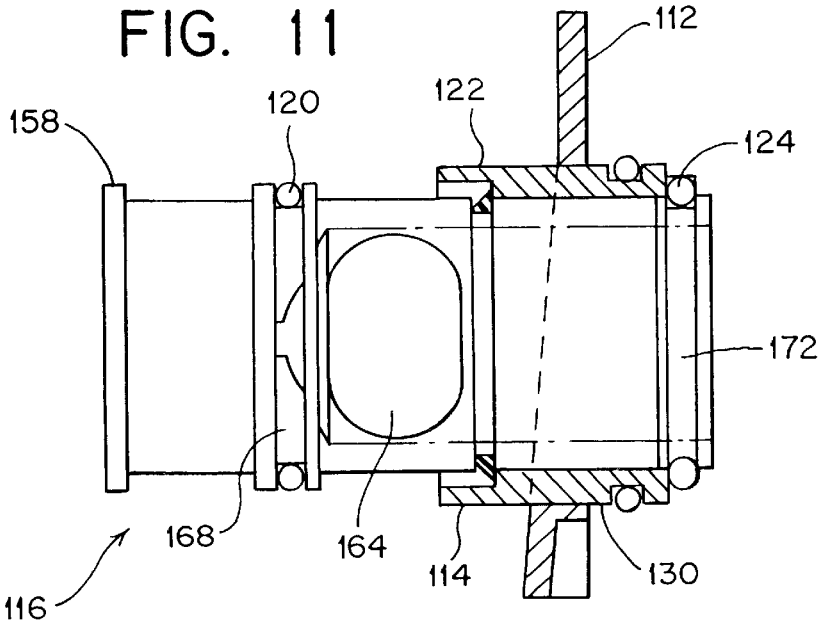
FIG. 11 is a partially transparent side elevation view in partial section of the surface breathing vent device of the invention shown in an open position.

As seen in FIGS. 5 and 11, the barrel 116 extends through the bushing 114 and the tubular portion 136 of the support plate 112 and is axially movable relative to them. When the surface breathing vent device 110 is in the closed position, the vent openings 164 are enclosed within the bushing 114 and the tubular portion 136 of the support plate 112. As seen best in FIGS. 11 and 12, the lip 158 of the barrel 116 may easily be pulled outward to move the barrel 116 within the bushing 114 and the tubular portion 130 of the support plate 112 to expose the vent holes 164 such that a wearer of the mask 100 can breathe ambient air therethrough.

When the surface breathing vent device 110 is in the closed position as shown in FIG. 5, the second O-ring 120 engages within the stepped opening 148 of the second open end 146 of the bushing 114 to form a water and air tight seal between the barrel and the bushing. In this position, the third O-ring 122 functions as a detent against the end 137 of the tubular portion 136 of the support plate 112.

Figure 12:
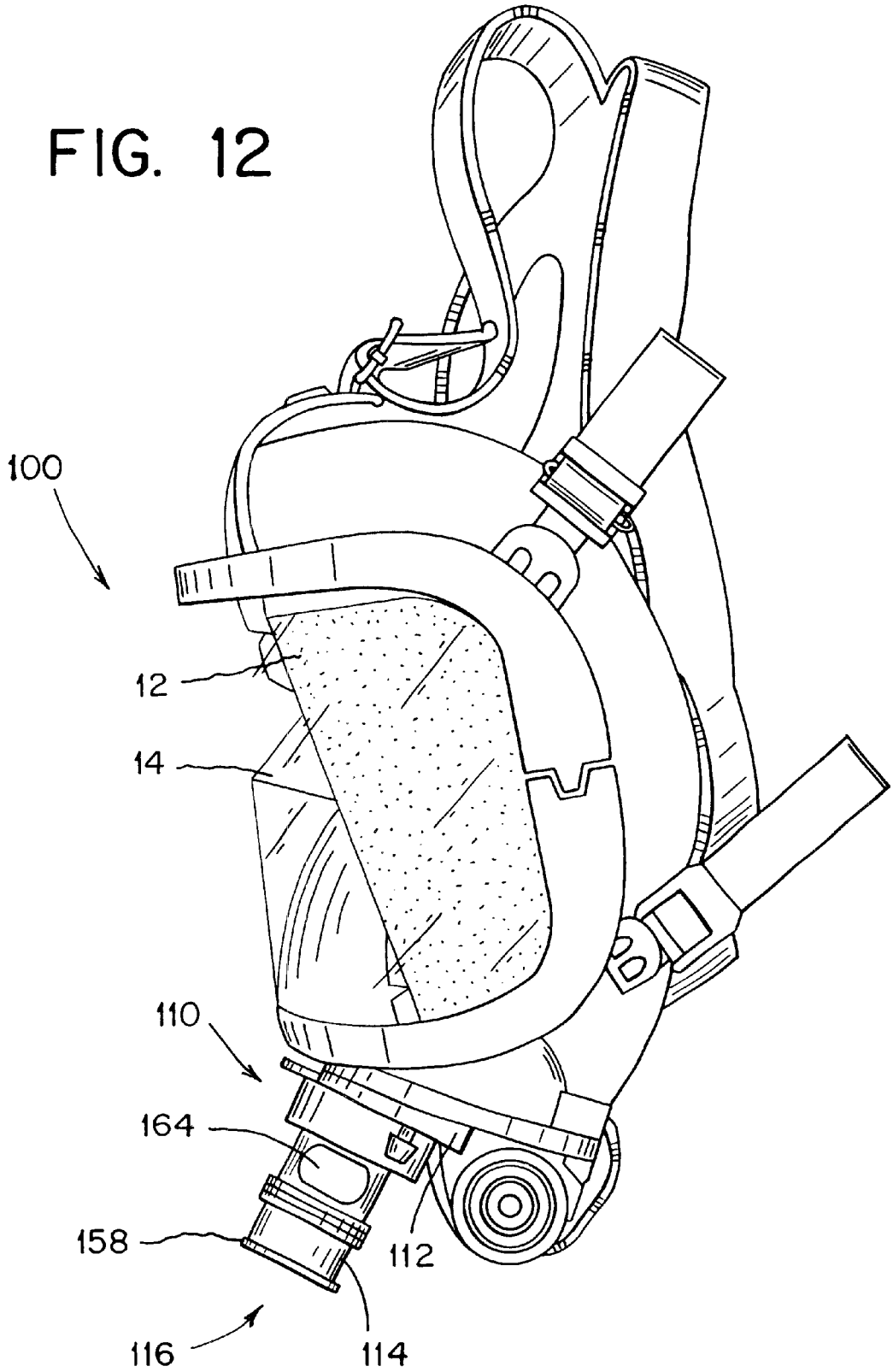
FIG. 12 is a view similar to FIG. 4 with the breathing vent device shown in the open position.

When the surface breathing vent device 110 is in the open position as shown in FIGS. 11 and 12, the second O-ring 120 does not engage the stepped opening 148 of the second open end 146 of the bushing 114 and no longer forms a water and air tight seal between the barrel and the bushing. The vent holes 164 are located outside of the bushing 114 and are exposed to ambient air which may enter into the barrel 116 and flow through it into the oral-nasal cup 14 of the mask 100. $CO_2$ inside the oral-nasal cup 14 is also free to flow through the barrel 116 and out through the vent holes 164. In this open position, the third O-ring 122 functions as a detent against the stepped opening 148 in the second open end of the bushing 114 to maintain the barrel in an open position when so desired. The fourth O-ring 124 prevents the barrel 116 from being inadvertently completely withdrawn from the support plate 112 and bushing 114.

Referring to FIG. 12, a microphone (not shown) may be provided in the vent holes 164 such that the vent device serves the dual purpose of a com port or breathing vent. (The microphone would be placed within the barrel 116 adjacent the first closed end 156.) In addition, because of the location of the surface breathing vent device 110 over the com port, the air flow through the vent device travels directly into the mouth and nose and does not pass the visor 12 of the face mask outside the oral-nasal cup 14. As a result, there exists relatively little dead space for the build-up of $CO_2$. Moreover, there is no need to drill or cut a hole in the visor 12; as such, the warranty of the mask is not affected. Furthermore, as two lateral vent holes 164 are provided for the passage of ambient air, a relatively larger vent area than capable with the prior art device is provided. I.e., the vent area is larger than the cross sectional area of the barrel.

There have been described and illustrated herein an embodiment of a surface breathing vent device for a SCUBA mask. While a particular embodiment of the invention has been described, it is not intended that the invention be limited thereto, as it is intended that the invention be as broad in scope as the art will allow and that the specification be read likewise. Thus, while a bushing member has been shown separate from a support plate, it will be appreciated that the support means may include the bushing member and plate may be molded as one integrally formed member. Furthermore, while no particular materials have been stated for the manufacture of particular components of the invention, it will be appreciated that any suitable materials may be used. Also, while two diametrically opposed vent openings have been disclosed, more or fewer vent openings may be provided. In addition, while the invention has been specifically described for use in association with a scuba mask, it should be noted that it may be used with any full mask breathing apparatus for other uses such as fire masks or other life support masks used in hazardous, toxic or oxygen-poor environments. It will therefore be appreciated by those skilled in the art that modifications could be made to the provided invention without deviating from its spirit and scope as so claimed.

What is claimed is:

1. A surface breathing vent device for a mask which permits the user wearing the mask to breath ambient air, the mask having an oral-nasal cup having a first port for communicating with a regulator and a second separate communications port, said breathing vent device comprising:

a) support coupling means for coupling said breathing vent device to said communications port of said mask, said coupling means provided with a bushing portion adapted to be in fluid communication with the oral-nasal cup;

b) a barrel axially movable within said bushing portion of said support coupling means, said barrel having a first open end, a second closed end, and at least one vent opening in fluid communication with said first open end, said barrel has a cross-sectional area and wherein said at least one vent opening is larger than the cross-sectional area of said barrel; and c) sealing means between said barrel and said bushing portion, wherein when said barrel is axially movable within said bushing portion from a first position where said at least one vent opening is at least partially exposed to ambient air, to a second position where said at least one vent opening is enclosed within said bushing portion and said sealing means provides a substantially water-tight seal between said at least one vent opening and the ambient air.

2. A surface breathing vent device according to claim 1, wherein:

said at least one vent includes at least one radial hole in said barrel.

3. A surface breathing vent device according to claim 1, wherein:

said sealing means is at least one O-ring provided about a circumference of said barrel.

4. A surface breathing vent device according to claim 1, wherein:

said barrel is provided with a peripheral first groove at or adjacent said first end of said barrel, and an O-ring stop is provided in said first groove, said O-ring stop preventing an inadvertent removal of said barrel from said bushing portion.

5. A surface breathing vent device according to claim 4, wherein:

said barrel is provided with a peripheral second groove, and a detent O-ring is provided in said second groove, said detent O-ring maintaining said barrel is in said closed position unless manual force is applied.

6. A surface breathing vent device according to claim 5, wherein:

said barrel is provided with a peripheral third groove, and said sealing means is provided in said third groove.

7. A surface breathing vent device for a mask which permits a user wearing the mask to breathe ambient air, the mask having an interior oral-nasal cup having a first port for communication with a regulator and a second, separate communication port, said surface breathing vent device comprising:

a) a support plate adapted to be coupled to said communication port, said support plate defining a hole adapted to be generally aligned with the com port;

b) a hollow bushing coupled to said support plate in alignment with said hole;

c) a barrel axially movable within said bushing, said barrel having a first open end, a second closed end, and at least one vent opening in fluid communication with said first open end, said barrel has a cross-sectional area and wherein said at least one vent opening is larger than the cross-sectional area of said barrel; and d) a sealing means between said barrel and said bushing, wherein when said barrel is axially movable within said bushing from a first position where said at least one vent opening is at least partially exposed to ambient air, to a second position where said at lest one vent opening is enclosed with said bushing and said sealing means provides a substantially water-tight seal between said at least one vent opening and the ambient air.

8. A surface breathing vent device according to claim 7, wherein:

said at least one vent opening includes a radial opening in said barrel.

9. A surface breathing vent device according to claim 7, wherein:

said barrel is provided with a peripheral first groove at or adjacent said first end of said barrel, and an O-ring stop is provided in said first groove, said O-ring stop preventing an inadvertent removal of said barrel from said bushing.

10. A surface breathing vent device according to claim 9, wherein:

said barrel is provided with a peripheral second groove, and a detent O-ring is provided in said second groove, said detent O-ring maintaining said barrel is in said closed position unless a manual force is applied.

11. A surface breathing vent device according to claim 10, wherein:

said sealing means is a sealing O-ring, and said barrel is provided with a peripheral third groove in which said sealing O-ring is received.

12. A surface breathing vent device according to claim 7, wherein:

said second end of said barrel is provided with a lip.

13. A surface breathing vent device for a mask which permits a user wearing the mask to breath ambient air, the mask having an oral-nasal cup having a first port for communicating with a regulator and a second, separate communications port, said breathing vent device comprising:

a) support coupling means for coupling said breathing vent device to the mask, said coupling means provided with a bushing portion adapted to be in fluid communication with the cup;

b) a barrel axially movable within said bushing portion of said support coupling means, said barrel having a cross-sectional area, a first open end, a second closed end, and at least one vent opening in fluid communication with said first open end, said at least one vent opening being larger than the cross sectional area of said barrel; and c) a sealing means between said barrel and said bushing portion of said support coupling means.

14. A breathing mask couplable to a breathing fluid tank, comprising:

a) a face structure including a visor portion and an oral-nasal cup having a first port coupled to a regulator and a second separate communications port;

b) a bushing in fluid communication with said communications port;

c) a barrel axially, movable within said bushing, said barrel having a first open end, a second closed end, and at least one vent opening in fluid communication with said first open end, said barrel has a cross-sectional area and wherein said at least one vent opening is larger than the cross-sectional area of said barrel; and d) sealing means provided between said barrel and said bushing, wherein when said barrel is axially movable within said bushing from a first position where said at least one vent opening is at least partially exposed to ambient air, to a second position where said at least one vent opening is enclosed within said bushing and said sealing means provides a substantially water-tight seal between said at least one vent opening and the ambient air.

15. A breathing mask according to claim 14, wherein:

said at least one vent opening includes at least one radial hole in said barrel.

16. A surface breathing vent device for a mask which permits the user wearing the mask to breathe ambient air, the mask having an oral-nasal cup having a first port for communicating with a regulator and a second separate communications port, said breathing vent device comprising:

a) support coupling means for coupling said breathing vent device to the communication port of the mask, said coupling means provided with a bushing portion adapted to be in fluid communication with the oral-nasal cup;

b) a barrel at least axially movable relative to said bushing portion of said support coupling means, said barrel having a cross-sectional area;

c) sealing means between said barrel and said bushing portion; and at least one of said bushing and said barrel having a vent opening which is opening is larger than the cross-sectional area of said barrel and wherein when said barrel is axially movable relative said bushing portion from a first position where said at least one vent opening is at least partially exposed to ambient air, to a second position where said at least one vent opening is closed and said sealing means provides a substantially air-tight and water-tight seal between said at least one vent opening and the ambient air.

17. A breathing mask couplable to a breathing fluid tank, comprising:

a) a face structure including a visor portion and an oral-nasal cup having a first port for communication with a regulator and a second separate communication port;

b) a bushing in fluid communication with the oral-nasal cup;

c) a barrel at least axially movable relative to said bushing, said barrel having a cross-sectional area; and d) a sealing means provided between said barrel and said bushing, wherein at least one of said bushing and said barrel having a vent opening which is opening is larger than the cross-sectional area of said barrel and wherein when said barrel is axially movable relative to said bushing from a first position where said at least one vent opening is at least partially exposed to ambient air, to a second position where said at least one vent opening is closed and said sealing means provides a substantially air and water tight seal between said at least one vent opening and the ambient air.

* * * * *